US006064284A

United States Patent [19]

Wakamatsu et al.

[11] Patent Number: 6,064,284

[45] Date of Patent: May 16, 2000

[54] DIELECTRIC RESONATOR DEVICE WITH A THERMAL - CONDUCTING MEMBER

[75] Inventors: Hiroki Wakamatsu, Kyoto; Taiyo Nishiyama, Otsu; Yukihiro Nakatani, Kyoto; Yoshihiro Himi, Muko, all of Japan

[73] Assignee: Murata Manufacturing Co., Ltd., Japan

[21] Appl. No.: 09/186,511

[22] Filed: Nov. 4, 1998

[30] Foreign Application Priority Data

Nov. 5, 1997 [JP] Japan ..... 9-302870

[51] Int. Cl.[7] ..... H01P 7/10

[52] U.S. Cl. ..... 333/202; 333/219.1

[58] Field of Search ..... 333/134, 202, 333/219.1, 234, 995

[56] References Cited

U.S. PATENT DOCUMENTS 4,423,397 12/1983 Nishikawa et al. ..... 333/219.1
5,796,320 8/1998 Hattori et al. ..... 333/219.1

FOREIGN PATENT DOCUMENTS 0789417 8/1997 European Pat. Off. .
4241025 6/1994 Germany .
9324970 12/1993 WIPO .

OTHER PUBLICATIONS

Patent Abstracts of Japan, vol. 95, No. 8, Sep. 29, 1995 & JP 07 135411 A (Murata Mfg. Co., Ltd.) May 23, 1995, abstract.

European Search Report dated Feb. 12, 1999.

*Primary Examiner*—Seungsook Ham
*Attorney, Agent, or Firm*—Ostrolenk, Faber, Gerb & Soffen, LLP

[57] ABSTRACT

A long-life highly reliable dielectric resonator, a dielectric filter using the dielectric resonator and a dielectric duplexer, in which the heat accumulated in concave portions is dissipated. The dielectric resonator comprises a frame, a column-shaped dielectric resonant element disposed so as to be integral with the frame at ends thereof, the concave portions formed from the external surface of the frame into the dielectric resonant element in the direction of the axis of the dielectric resonant element, a conductor formed on the overall outer surface of the frame including inside the concave portions, and thermal-conducting means inserted in the concave portions.

6 Claims, 5 Drawing Sheets

DIELECTRIC RESONATOR DEVICE WITH A THERMAL - CONDUCTING MEMBER

BACKGROUND OF THE INVENTION

1. Field of the Invention

The present invention relates to a TM mode dielectric resonator having a frame and a dielectric resonant element, wherein the frame has concave portions formed from the external surface of the frame toward the dielectric resonant element along the axis of the dielectric resonant element. The present invention also relates to a dielectric filter using the dielectric resonator.

2. Description of the Related Art

The structure of a conventional dielectric resonator 110 will be described with reference to FIG. 7. In FIG. 7, a frame 111 and a cross-shaped dielectric resonant element 112, which is formed by two column-shaped dielectics orthogonaly integrated with each other, are generally formed in one piece of dielectric ceramic. Concave portions 114 are formed from the external surface of the frame 111 in the directions of each axis of the crossing portions of the dielectric resonant element 112. These concave portions 114 are formed with the intent of miniaturizing the dielectric resonator and multiplexing the mode. A conductor 113 covers the overall external surface of the frame 111 including inside the concave portions 114. The conductor 113 may be formed, for example, by applying silver paste followed by burning.

Next, a dielectric filter 120 utilizing the dielectric resonator will be described with reference to FIG. 8. In FIG. 8, a metal panel 121 is fixed to the dielectric resonator so as to cover the opening of the dielectric resonator, and a metal case 122 accommodates the dielectric resonator. The metal panel 121 is fixed to the dielectric resonator 110 by soldering. An external connector 123 for input-output of signals is formed on the metal panel 121, and a loop 124 for connecting is attached to the external connector 123. The metal case 122 plays the role of the functions of fixing of the external connector 123 and the dielectric resonator 110 and protecting the dielectric resonator from an external impact. In order to fix the dielectric resonator 110, spring forces exerted by protruding portions 125 which are formed on the metal case 122 extending inwardly are utilized. The dielectric resonator 110 is fixed at a plurality of points where these protruding portions are located.

The dielectric resonator generates heat when fed a current from the outside. If the dielectric resonator cannot dissipate the heat, the temperature of the dielectric resonator increases with the generation of the heat causing characteristics of the dielectric resonator to deteriorate because of reduction of Qo (Q at no-load) and the like. The heat of the aforementioned concave portions on the dielectric resonator, where there is a large amount of heat generated, is difficult to be dissipated by convection because of the inwardly concave structure. Accordingly, the amount of heat at the concave portions may increase. The problem of the heat dissipating from the concave portions has been particularly acute.

When the dielectric resonator is fixed to a metal panel and is encased in a case to be used at a base station, etc. as a dielectric filter, the heat-dissipating problem becomes more serious because of increased current from the outside.

The heat-dissipating processes of the aforementioned dielectric filter are now described. The heat generated at the dielectric resonator is dissipated through three routes. First, there is a heat-conducting route from the dielectric resonator to the metal case through the metal panel. In this route, the heat is conducted through metals having a high thermal conductivity. However, since the dielectric resonator is fixed to the case by the protruding portions which extends inwardly from the case, as described above, there are only several contact points between the metal panel and the metal case and the contact area is so small as not to dissipate sufficient heat. Secondly, there is a convection route of air which is located in a clearance between the dielectric resonator and the case. Since the protruding portions are formed as to be recessed inwardly, it is difficult for heat to dissipate by convection through this route. Finally, there is a heat radiation route. However, there cannot be a sufficient amount of heat radiated to prevent the temperature of the dielectric resonator from rising.

The temperature in the dielectric filter is raised because there is insufficient heat dissipation at the dielectric resonator especially at the concave portions as described above. Therefore, the temperature of the solder used to connect the dielectric resonator to the metal panel is also raised. Because solder generally has a low melting point, the solder may partially melt by the rise in temperature. This results in displacing of the metal panel and variations in a resonating cavity. Therefore, long-life high reliability of the dielectric filter cannot be ensured.

SUMMARY OF THE INVENTION

Accordingly, it is an object of the present invention to provide a long-life highly reliable dielectric resonator and a dielectric filter using the dielectric resonator by restraining of the reduction of Qo of the dielectric resonator and preventing the solder between the dielectric resonator and the metal panel from deterioration.

In order to achieve the aforementioned object, in a first aspect of the present invention, the dielectric resonator comprises a frame; a column-shaped dielectric resonant element disposed so as to be integral with the frame at ends thereof; concave portions formed from the external surface of the frame into the dielectric resonant element in the direction of the axis of the dielectric resonant element; a conductor formed on the overall outer surface of the frame including inside of the concave portion; and thermal-conducting means inserted in the concave portions.

In the dielectric resonator, the thermal-conducting means may have center portions and radial portions, which continuously extend radially from the center portions and are folded in a shape corresponding to the shape of the concave portions.

In a second aspect of the present invention, a dielectric filter comprises a dielectric resonator; and a case which contains the dielectric resonator, wherein the dielectric resonator includes a frame; a column-shaped dielectric resonant element disposed so as to be integral with the frame at ends thereof; concave portions formed from the external surface of the frame into the dielectric resonant element in the direction of the axis of the dielectric resonant element; a conductor formed on the overall outer surface of the frame including inside the concave portions; and thermal-conducting means inserted in the concave portions being in contact with the case.

In the dielectric filter, the thermal-conducting means may have center portions and radial portions, which continuously extend radially from the center portions and are folded in a shape corresponding to the shape of the concave portions.

In a third aspect of the present invention, a dielectric duplexer comprises the dielectric filter which incorporates the aforementioned features.

By these configurations described above, the heat at the concave portions of the dielectric resonator can be efficiently dissipated and the Qo of the dielectric resonator can be prevented from reducing. A dielectric filter using the dielectric resonator in which the heat is efficiently dissipated can be produced with low cost.

DESCRIPTION OF THE PREFERRED EMBODIMENTS

A dielectric resonator and a dielectric filter using the dielectric resonator according to the Embodiment of the present invention will be described below.

Figure 1:
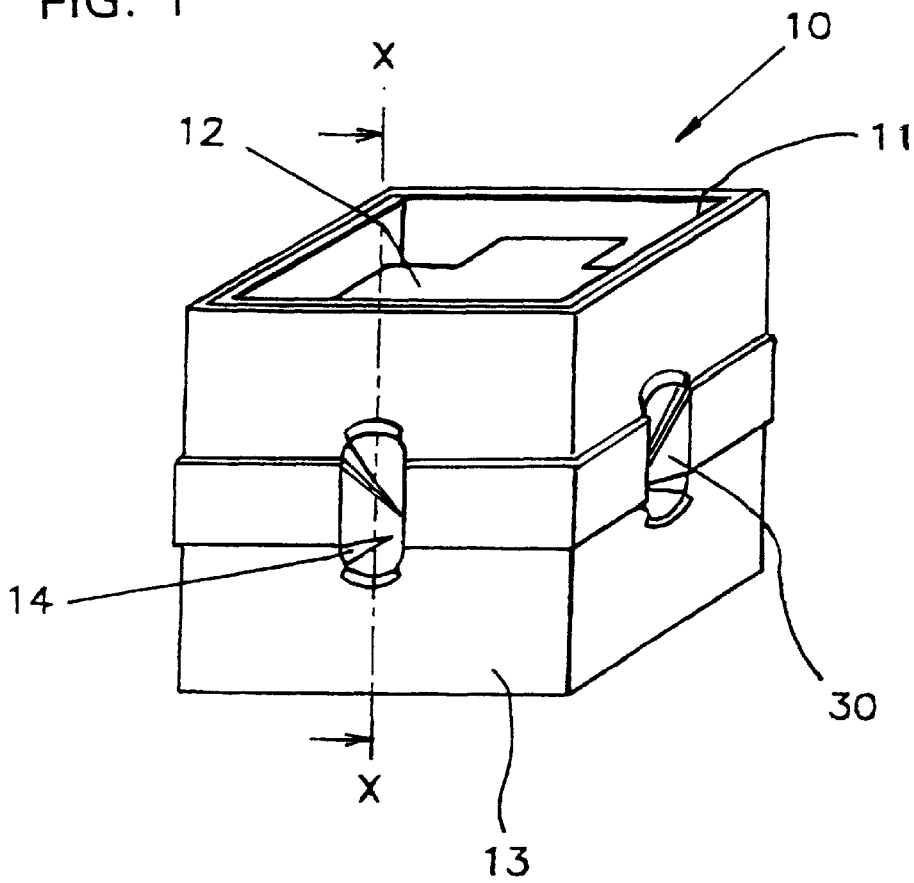
FIG. 1 is a perspective view illustrating a dielectric resonator according to the present invention.
Figure 2:
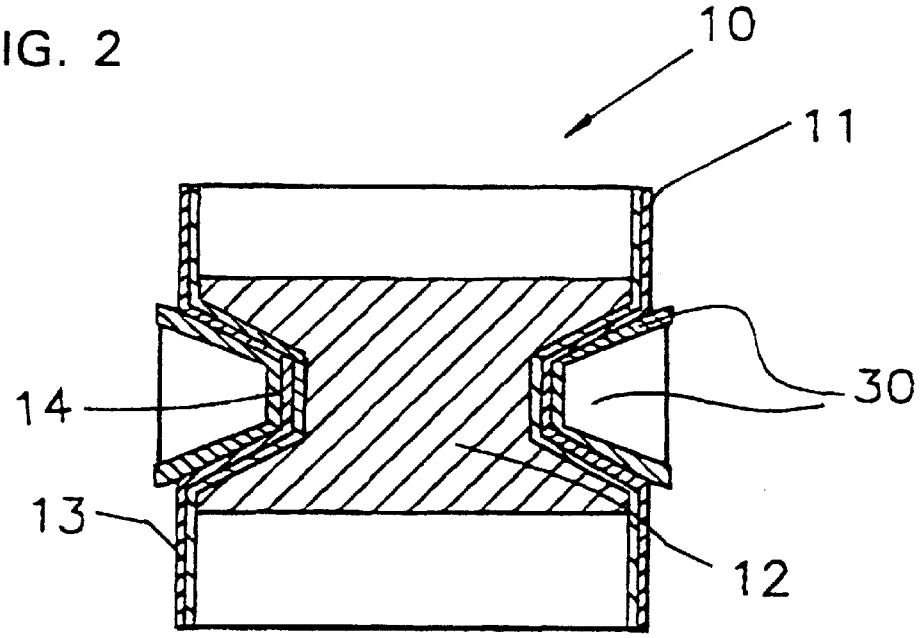
FIG. 2 is a sectional view at the line X—X of FIG. 1 of the dielectric resonator.

FIG. 1 is a perspective view of a dielectric resonator 10 according to the present invention, and FIG. 2 is a sectional view at the line X—X of FIG. 1. In FIGS. 1 and 2, a frame 11 and a dielectric resonant element 12 are formed in one-piece by injection molding of ceramic, for example. At this time, concave portions 14 are formed from the external surface of the frame 11 toward the dielectric resonant element 12 along the axis of the dielectric resonant element. In the dielectric resonator 10 having a cross-shaped dielectric resonant element according to the Embodiment, by forming the concave portions 14, the dielectric resonator having multiple mode characteristics can be obtained without upsizing. Next, on the overall external surface of the frame 11 including inside of the concave portions 14, a conductor 13 is formed by coating and burning silver paste.

Figure 3A:
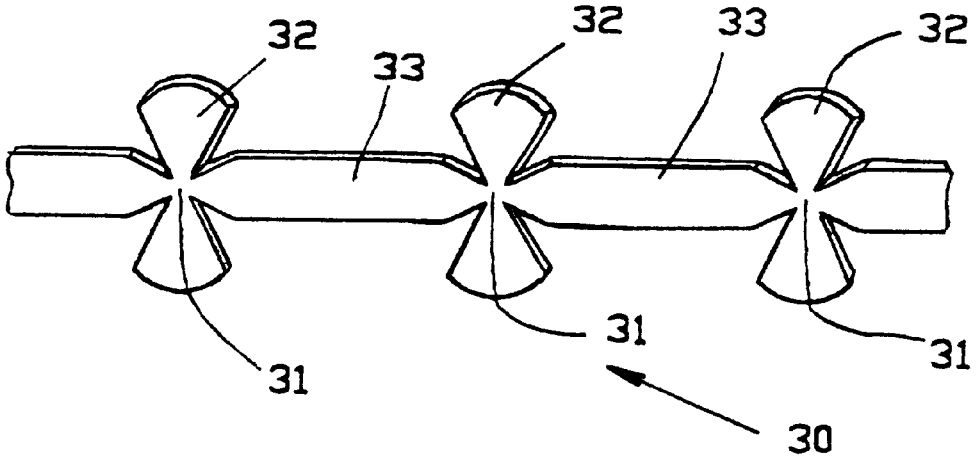
FIG. 3A is a perspective view illustrating a thermal-conducting member according to the invention before folding.
Figure 3B:
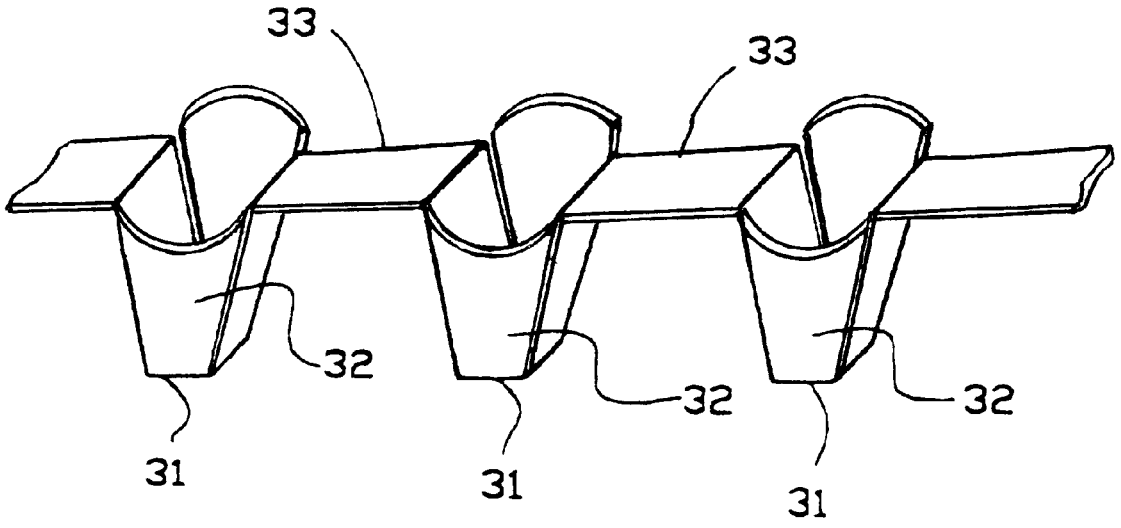
FIG. 3B is a perspective view illustrating the thermal-conducting member after folding.

In the concave portions 14, a thermal-conducting member 30 is inserted. An aluminum plate or a copper plate is stamped in a shape, as shown in FIG. 3A, having center portions 31, radial portions 32 which continuously extend radially from the center portions 31 and connecting portions 33 which connect adjacent radial portions 32 to each other, and then is folded in a shape, as shown in FIG. 3B, corresponding to the shape of the concave portions of the dielectric resonator. By virtue of this structure, the heat in the concave portions 14 of the dielectric resonator 10 is conducted through the thermal-conducting member 30 to be dissipated in the ambient air. The heat is also prone to conduct through the connecting portions 33 of the conducting member 30 to be efficiently dissipated. When silicone grease or a thermal-conducting sheet, etc., is inserted between the dielectric resonator 10 and the thermal-conducting member 30, the thermal contact resistance between the dielectric resonator 10 and the thermal-conducting member 30 is reduced such that the heat can be efficiently dissipated further.

Figure 4:
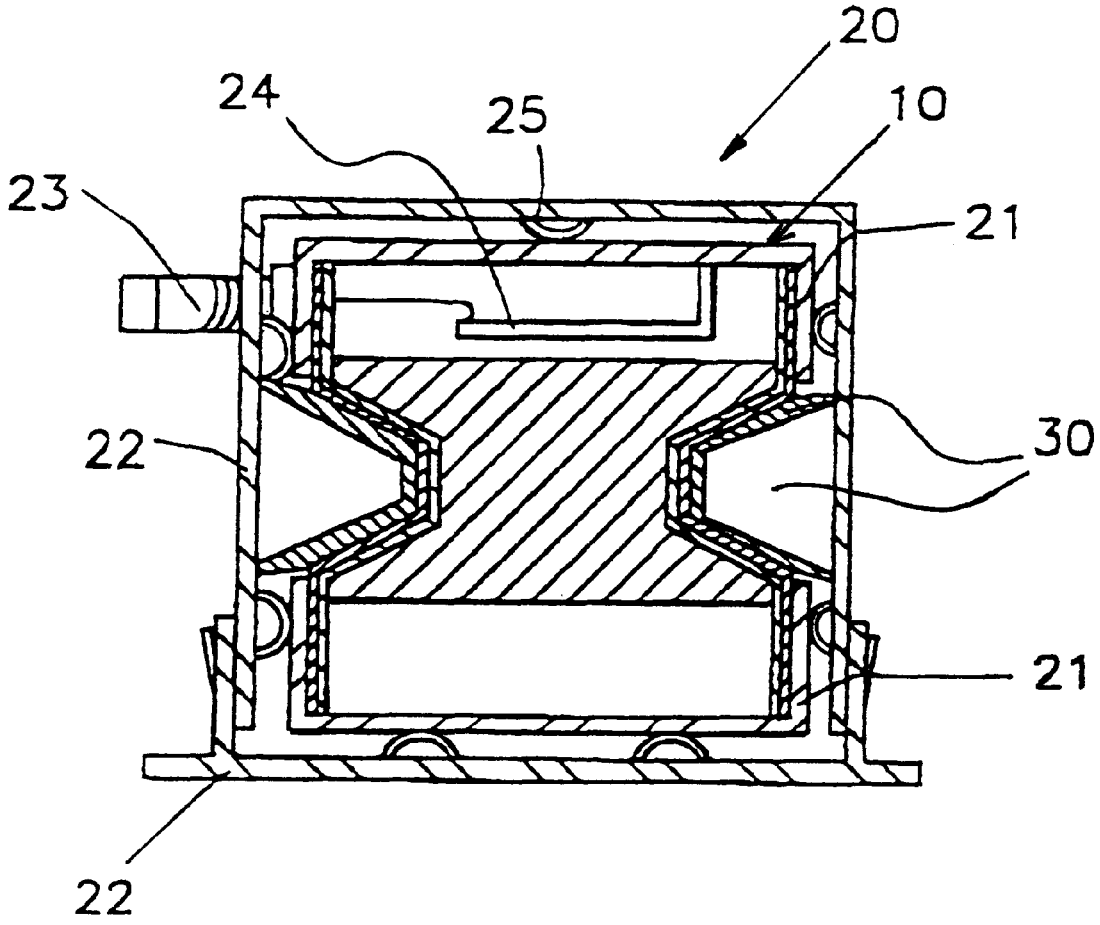
FIG. 4 is a cross-sectional view of a dielectric filter according to the present invention.

A dielectric filter 20 using the dielectric resonator 10 as above will now be described. FIG. 4 is a sectional view at the same line of FIG. 1. Since the dielectric resonator 10 and the thermal-conducting member 30 are the same as in FIG. 1, the description thereof is abbreviated. In FIG. 4, a metal panel is designated by the numeral 21, and a metal case 22 contains the dielectric resonator 10.

The metal panel 21 is formed of an alloy of nickel and iron, for example, of which the coefficient of linear expansion is approximately the same as that of the dielectric resonator 10. By equalizing the coefficient of linear expansion of the dielectric resonator 10 and that of the metal panel 21, deterioration of the junction ability can be avoided because no force is applied to the junction portion between the dielectric resonator 10 and the metal panel 21 when the temperature changes. An external connector 23 for input-output of an outside signal is formed on the metal panel 21. A loop for connecting the input-output portion 24 to magnetically connecting the input-output portion and the dielectric resonator 10 is attached to the external connector 23. The metal panel 21 is fixed to the dielectric resonator 10 by soldering so as to cover the opening of the dielectric resonator 10.

The case 22 which contains the dielectric resonator 10 is used in order to protect the dielectric resonator 10 from an external impact and to fix the dielectric resonator 10 and the external connector 23. In order to fix the dielectric resonator 10, spring forces of protruding portions 25 which are formed on the metal case extending inwardly are utilized. The thermal-conducting member 30 is inserted into the concave portions 14 of the dielectric resonator 10 and a partial portion of the thermal-conducting member 30 is in contact with the case 22. This results in direct conduction of the heat of the concave portions 14 to the case 22 from the thermal-conducting member 30 to be dissipated in the ambient air. At this time, when silicone grease or a thermal-conducting sheet, etc. is inserted between the dielectric resonator 10 and the thermal-conducting member 30, and between the thermal-conducting member 30 and the case 22, the thermal contact resistance between the dielectric resonator 10 and the thermal-conducting member 30 is reduced such that the heat can be efficiently dissipated.

Figure 5A:
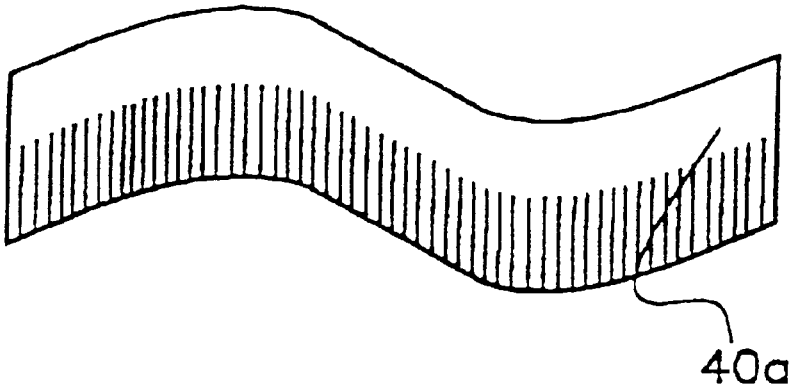
FIG. 5A is a perspective view of another thermal-conducting member before winding.
Figure 5B:
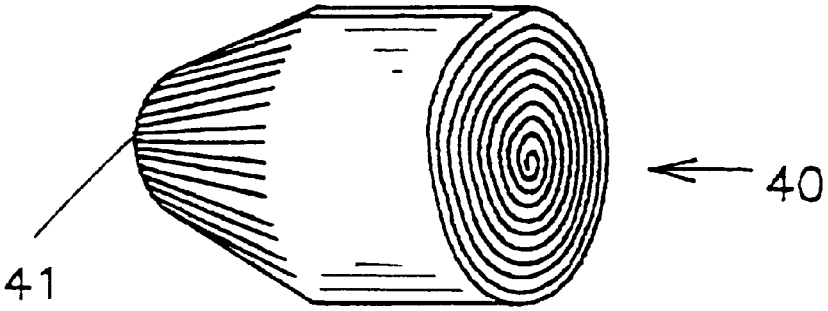
FIG. 5B is a perspective view of the thermal-conducting member after winding.

Another Embodiment of the present invention will now be described. In this Embodiment, aluminum foil or the like is utilized as the thermal-conducting member. That is, a thermal-conducting member 40 of this Embodiment is formed, as shown in FIG. 5A, by making slits on a strip of aluminum foil 40 perpendicularly to the longitudinal direction and by winding it in a roll, as shown in FIG. 5B. The slit side 41 is inserted into the concave portion of the dielectric resonator 10 for use.

Figure 6:
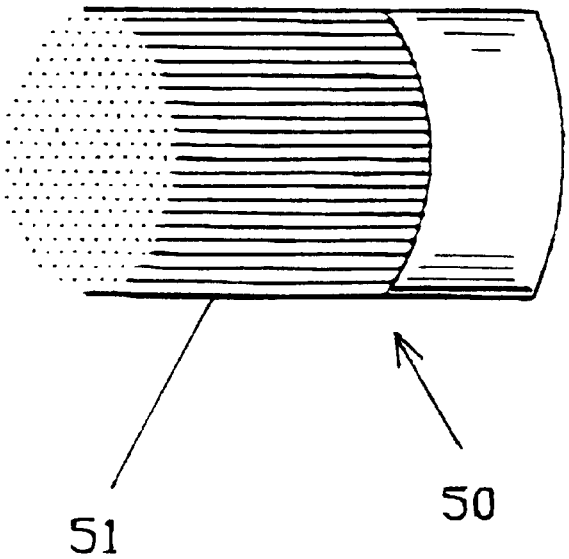
FIG. 6 is a drawing of a thermal-conducting member of another Embodiment of the present invention.
Figure 7:
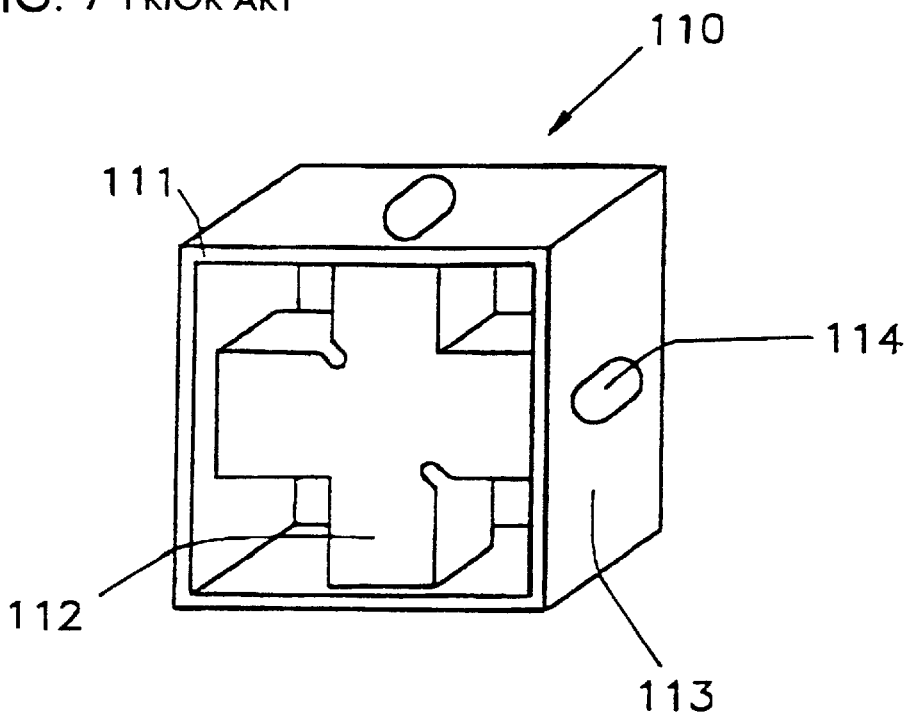
FIG. 7 PRIOR ART
FIG. 7 is a perspective view of a conventional dielectric resonator.
Figure 8:
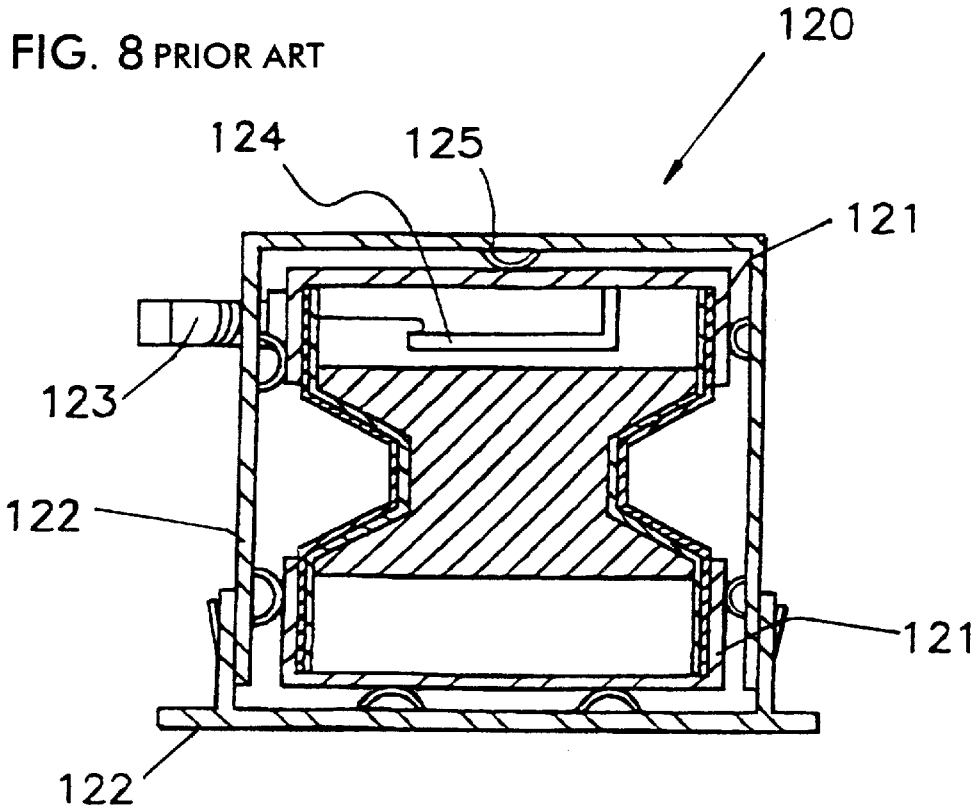
FIG. 8 PRIOR ART
FIG. 8 is a cross sectional view of a conventional dielectric resonator.

Still another Embodiment of the present invention will now be described. In this Embodiment, a thermal-conducting member 50 is formed by piling together some lengths of wire 51 of aluminum or copper, etc., so as to be bundled at one end to produce a brush-shape, as shown in FIG. 6. The wire 51 side is inserted into the concave portion 14 of the dielectric resonator 10. At this time, when silicone grease or a thermal-conducting sheet, etc. is inserted therebetween, the heat can be dissipated efficiently the same as the Embodiment shown in FIG. 1. The contact area between the thermal-conducting member and the concave portion 14 is increased by forming the thermal-conducting member in a shape as shown in FIG. 5 or 6. Further, the cross sectional area of the thermal-conducting member in a plane parallel to the opening surface of the concave portion 14 is also increased. Accordingly, the heat in the concave portion 14 may be transmitted to the thermal-conducting member to be dissipated in ambient air in a large quantity.

It is generally preferable that the material of the thermal-conducting member be a metal having high thermal conductivity. However, any material can be used as long as it does not have any adverse effect on the characteristics of the dielectric resonator 10 and the dielectric filter using the dielectric resonator, and it can efficiently conduct the heat.

In the Embodiments according to the present invention, although a dielectric filter is described, an oscillator, for example, can be applied to the invention as long as the dielectric resonator according to the present invention is used.

In the Embodiments according to the present invention, although a dielectric resonator having a cross-shaped resonant element is described, the invention is not limited to this shape. A single column-shaped resonant element, for example, can be applied to the present invention as long as the dielectric resonator is formed of the concave portions extending from the external surface of the frame in the direction of the axis of the dielectric resonant element.

Further, a dielectric duplexer can be provided combining a plurality of the dielectric resonators according to the present invention.

The present invention offers the following advantages.

In accordance with the basic feature of the present invention, the temperature rise in the dielectric resonator and in the dielectric filter that uses the dielectric resonator can be restrained by dissipation of the heat accumulated in the concave portions which is formed from the external surface of the frame in the direction of the axis of the dielectric resonant element. Accordingly, reduction of Qo and deterioration of solder which is used to connect the dielectric resonator and the metal panel can be prevented. Therefore, a long-life highly reliable dielectric resonator and dielectric filter using the dielectric resonator can be provided by solving the problems of the characteristics such as the reduction of Qo and variations in a resonating cavity.

In the dielectric resonator and the dielectric filter, the thermal-conducting member can be mass-manufactured because the thermal-conducting member may be stamped in a shape. Therefore, heat dissipation from the concave portions can be implemented at a moderate cost.

The present invention also provides a dielectric duplexer in which heat can be efficiently dissipated because the dielectric duplexer has the dielectric resonator which incorporates the aforementioned features.

What is claimed is:

1. A dielectric resonator comprising:

a frame;

a column-shaped dielectric resonant element disposed so as to be integral with said frame at ends thereof;

concave portions formed from the external surface of said frame into said dielectric resonant element in the direction of the axis of said dielectric resonant element;

a conductor formed on the overall outer surface of said frame including inside said concave portions; and thermal-conducting means inserted in said concave portions.

2. A dielectric resonator according to claim 1, wherein said thermal-conducting means have center portions and radial portions, which continuously extend radially from said center portions and are folded in a shape corresponding to the shape of said concave portions.

3. A dielectric filter comprising:

a dielectric resonator; and a case which contains said dielectric resonator, wherein said dielectric resonator includes a frame; a column-shaped dielectric resonant element disposed so as to be integral with said frame at ends thereof; concave portions formed from the external surface of said frame into said dielectric resonant element in the direction of the axis of said dielectric resonant element; a conductor formed on the overall outer surface of said frame including inside said concave portions; and thermal-conducting means inserted in said concave portions being in contact with said case.

4. A dielectric filter according to claim 3, wherein said thermal-conducting means have center portions and radial portions, which continuously extend radially from said center portions and are folded in a shape corresponding to the shape of said concave portions.

5. A dielectric filter for a duplexer comprising: at least one dielectric filter, wherein said at least one dielectric filter comprises a dielectric resonator; and a case which contains said dielectric resonator, wherein said dielectric resonator includes a frame; a column-shaped dielectric resonant element disposed so as to be integral with said frame at ends thereof; concave portions formed from the external surface of said frame into said dielectric resonant element in the direction of the axis of said dielectric resonant element; a conductor formed on the overall outer surface of said frame including inside said concave portions; and thermal-conducting means inserted in said concave portions being in contact with said case.

6. A dielectric filter for a duplexer according to claim 5, wherein said thermal-conducting means have center portions and radial portions, which continuously extend radially from said center portions and are folded in a shape corresponding to the shape of said concave portions.

* * * * *